US005437452A

United States Patent [19]

Graf et al.

[11] Patent Number: 5,437,452

[45] Date of Patent: Aug. 1, 1995

[54] ROULETTE BOWL HAVING A ROULETTE WHEEL

[75] Inventors: Johann Graf; Werner Machac, both of Gumpoldskirchen, Austria

[73] Assignee: Novo-Invest Development Aktiengesellschaft, Gumpoldskirchen, Austria

[21] Appl. No.: 94,049

[22] PCT Filed: Jan. 20, 1992

[86] PCT No.: PCT/AT92/00004

§ 371 Date: Jul. 22, 1993

§ 102(e) Date: Jul. 22, 1993

[87] PCT Pub. No.: WO92/12773

PCT Pub. Date: Aug. 6, 1992

[30] Foreign Application Priority Data

Jan. 22, 1991 [AT] Austria ..... 128/91

[51] Int. Cl.[6] ..... A63F 5/00

[52] U.S. Cl. ..... 273/142 E

[58] Field of Search ..... 273/142 E, 142 F

[56] References Cited

U.S. PATENT DOCUMENTS 1,474,488 11/1923 Nelson ..... 273/142 F

FOREIGN PATENT DOCUMENTS 0101522 2/1984 European Pat. Off. .
465670 4/1914 France .
810827 3/1937 France .
816531 8/1937 France ..... 273/142 E

*Primary Examiner*—Benjamin H. Layno
*Attorney, Agent, or Firm*—Cohen, Pontani, Lieberman, Pavane

[57] ABSTRACT

The invention concerns a roulette bowl, in particular for the use in gambling casinos, having a roulette wheel. According to the invention it is provided that the roulette wheel (4) carries a ring (5) having radially extending fins (10) that confine the fields (32) and that the fins (10) confining the fields (32) are constructed in one single piece with the ring (5) that preferably is deep-enedly inserted into a recess of the roulette wheel (4) (FIG. 1).

16 Claims, 2 Drawing Sheets

ROULETTE BOWL HAVING A ROULETTE WHEEL

BACKGROUND TO THE INVENTION

The invention relates to a roulette bowl, in particular for use in gambling casinos, having a roulette wheel.

From the French patent specification 810,827 a roulette wheel is known, which, however, does not correspond to the "classic" roulette discs as they are used in casinos. This roulette wheel carries a circular ring put onto an upwardly extending protrusion of the roulette wheel. The fins confining the pockets are screwed to the circular ring in an usual manner.

Within known roulette wheels as they are used in the roulette bowls in casinos, the 37 pockets are recessly disposed and separated from each other by radially extending fins screwed to the roulette wheel. It is known that roulette wheels and roulette bowls are frequently subject to manipulation and that as well the managers as also the gamblers are afraid of manipulations on the gambling apparatus. Just the fins are subject of various manipulations and the invention has at its object to provide a roulette bowl having a roulette wheel for gambling casinos or, respectively, similar establishments, that excludes manipulations as far as possible, that ensures an optimal compromise between a gambling process desired by the manager and by the gambler and that as far as possible excludes apparatus-own inaccuracies in order to avoid a preference of numbers even if this preference amounts to some percent advantage only with regard to a hit or, respectively, winnings.

SUMMARY OF THE INVENTION

According to the invention, a roulette bowl having a roulette wheel of the initially described kind is characterized in that the roulette wheel disc carries a ring having radially extending fins confining the pockets and that the fins confining the pockets are developed in one single piece with the ring that preferably is recessly inserted into a recess of the roulette wheel.

By the integral construction of the fins with the ring or, respectively, with the roulette wheel, a manipulation of the fins is completely avoided. The fins cannot loosen or, respectively, the field width is exactly predetermined and cannot be changed by misplacing of the fins that can be screwed on; thus the statistic frequency of the hits cannot be changed later on. Usually, the fins are inserted by hand when producing the roulette bowl considering an exact radial direction and an exact equal width of the fields. This requires enormous effort that exceeds considerably the effort of a very exact production of an insertion ring having fins integrally moulded thereon, and according to the invention there is the advantage that the fins or, respectively, the field width cannot fraudulently altered later on. The possibility known among gamblers, to change the width of the fins, what cannot be seen with the naked ey, may cause advantages up to an order of more than 3% of an increase of the winnings chances.

Further, the exact manufacture of the insertion ring with the fins enables an improvement of the smoothness and exactness of running of the roulette eel so that the roulette wheel that is bearingly supported in the roulette trough on a trunnion having a flanged portion is optimally balanced; by this reason according to a further embodiment of the invention, the trunnion carrying the roulette wheel together with the recessly disposed inserted ring is constructed integrally with the flange portion and is formed by machining, in particular by turning on the lath and grinding together with the flange portion. Up to now it was usual to form the trunnion carrying the roulette wheel and the flange portion screwed in the roulette bowl at the bottom in two elements and to weld these elements together. By this welding, however, due to heat tensions minor inaccuracies in the alignment of the trunnion with respect to the flange portion or, respectively, to the bottom of the roulette bowl are created despite a subsequent machining, which inaccuracies till now were not of importance because due to the fins inserted (inexact) by hand these relative small inaccuracies were not of great weight. By the now inserted insert ring having the integral fins, however, the balance of the roulette disc is so improved that is has been shown of advantage to form also the flange portion with the bearing trunnion in one single piece in a very exact manner, in order to not reduce the advantages in exactness obtained by the insert ring formed with the fins in one single piece by this exact integral forming, but to further enhance these advantages.

Thus, according to the invention a smooth running, almost exact running roulette wheel is obtained which excludes manipulations almost completely.

It is of advantage if the insert ring and the fins are formed or, respectively, cast massively of brass and are manufactured by machining, in particular by milling. When compared with aluminium used heretofore, brass has the advantage that it has a greater specific weight, what results in a more quiet and longer running roulette disc, noting that, however, brass has advantages when it is machined. Further, brass is—as aluminium—not magnetic and not magnetizable so that manipulations by means of magnets are excluded. Further, the surface of brass can easily be finished or, respectively, coated and it is of particular advantage if at least the surface of the fins is nickel-plated or chromium-plated. Thereby manipulations at the fins, for example by grinding off the fins and correspondingly enlarging the fields, are avoided because such manipulations can immediately be seen.

By making the massive brass fins integral with the insert ring, a loosening or an exchange of the fins is avoided, which will be necessary if the fins are loosened and cannot more been clamped or, respectively, fixed by screwing. According to the invention it is possible to entirely exchange the very exactly manufactured insert ring together with the fins, which procedure is well-comed by the gamblers and the manager and can be done in a very short time because the insert ring is deepened fitted into a recess of the roulette wheel and is screwed therein.

A further requirement which must be met by a roulette wheel or, respectively, by a roulette bowl, is the unpredictability of a pitch made by the croupier. The manager desires that the bowl jumps as long as possible in order to destroy as much as possible the chances of a gambler who likes to predetermine the pitch; the gambler desires a certain unpredictability of the pitch, however figures out a small chance on the basis of the rotation of the roulette wheel and the run of the ball to perceive in the last moment the field in which the ball rests; the gambler desires therefore, that the ball hops as few as possible and rests as soon as possible. Therefore, it was an object of the invention to provide for an exactest possible insert ring with fins, that besides of its accuracy and in connection therewith the statistic requirements of the manager meets also the requirements of the gamblers with regard to the behaviour of the ball. Due to the exact construction of the roulette wheel and the properties of the roulette disc which will be described in the following, the manager can be sure that a pitch runs completely according to statistic points of view, whereas the gambler is not irritated by too large hops and irregularities in the run of the ball. By a plurality of experiments and tests by cropiers and gamblers, an embodiment of the fins or, respectively, of the insert ring could be reached which ensures an optimal course of the game which is independent from the two usual diameters of the used roulette balls (19 mm or 22 mm).

According to the invention it is preferred that the back or, respectively, the back edge of the fins shows a kink, the height of the outer back region (edge) remaining substantially unchanged and the height of the inner back region (edge) decreasing towards the inside, the kink angle between the two sections being in the range between 2° to 12°, preferably between 4° to 10°, in particular between 6° to 8°. Within this, it is suitable if the kink angle is positioned spaced apart from the outer fin end for an amount in the region of 40 to 60%, preferably 45 to 55% of the ring width or, respectively, if the height of the fins in the outer region amounts to 15 to 27%, preferably 18 to 24% of the width of the insert ring. The fin which is higher on its outside, gives the arriving ball a strong push, however causes at the same time a good "catch" of the ball or, respectively, prevents that the ball escapes from a field even if the ball has a certain intrinsic velocity relative to the roulette wheel which is not too great. The back edges of the fins that taper off from the kink point towards the inside allow that the ball which has been fallen onto the roulette cone, can almost unhindered enter the fields so that at such pitches also jumping of the ball is almost avoided. This behaviour of the ball is still further improved if the fins in their upper end region are provided with inclined surfaces on both sides, the course of the height of which is in the outer region between 1 to 3 mm, preferably between 1.5 to 2.5 mm, and the course of the height in the inner region is between 0.5 to 2.5, preferably between 1 to 2 mm, which inclined surfaces merge into each other, particularly with a surface intersection. Within this, it may be provided that the inclined surfaces or, respectively, chamfers include with the horizontal direction in the outer fin region an angle between 40° to 50°, preferably of about 45°, and in the inner fin region an angle between 30° to 40°, preferably about 35°.

It has been shown that the ball thrown in by the croupier, independent from whether balls having a great diameter (22 mm) or a small diameter (19 mm) have been used, at the revolution speeds of the roulette disc and ball velocities of the throw usual in casinos, was subject to a strong deflection by engaging a fin after having been uncalculably deflected by a baffle provided within the roulette bowl, said deflection not being directed upwardly, but more in a direction obliquely to above, whereupon the ball was uncalculably deflected, however rather soon rested in a field without particular further hops.

The selected construction of the fins resulted in a very great statistic dispersion of the pitches and, therefore,in a very great security for the manager; at the same time, however, the gambler's desire of a soon stillstand of the ball was met.

The smooth run of the ball is also enhanced if the fins being integral with the insert ring are provided in their inner end section with a nose directed inwardly and having a bottom edge that rises upwardly, which nose rests on a rising ring surface of an annular-shaped protrusion of the roulette wheel or, respectively, if the outer end of the back edge of the fins is disposed at the same level as an inner edge of an inwardly sloping annular surface of the roulette wheel.

In the following, an exemplative embodiment of the invention is explained in detail by way of the drawing. FIG. 1 shows a section through an inventive roulette bowl. FIG. 2 shows an insertion ring and FIGS. 3 to 5 show different views of fins.

DETAILED DESCRIPTION OF THE PREFERRED EMBODIMENT

Figure 1:
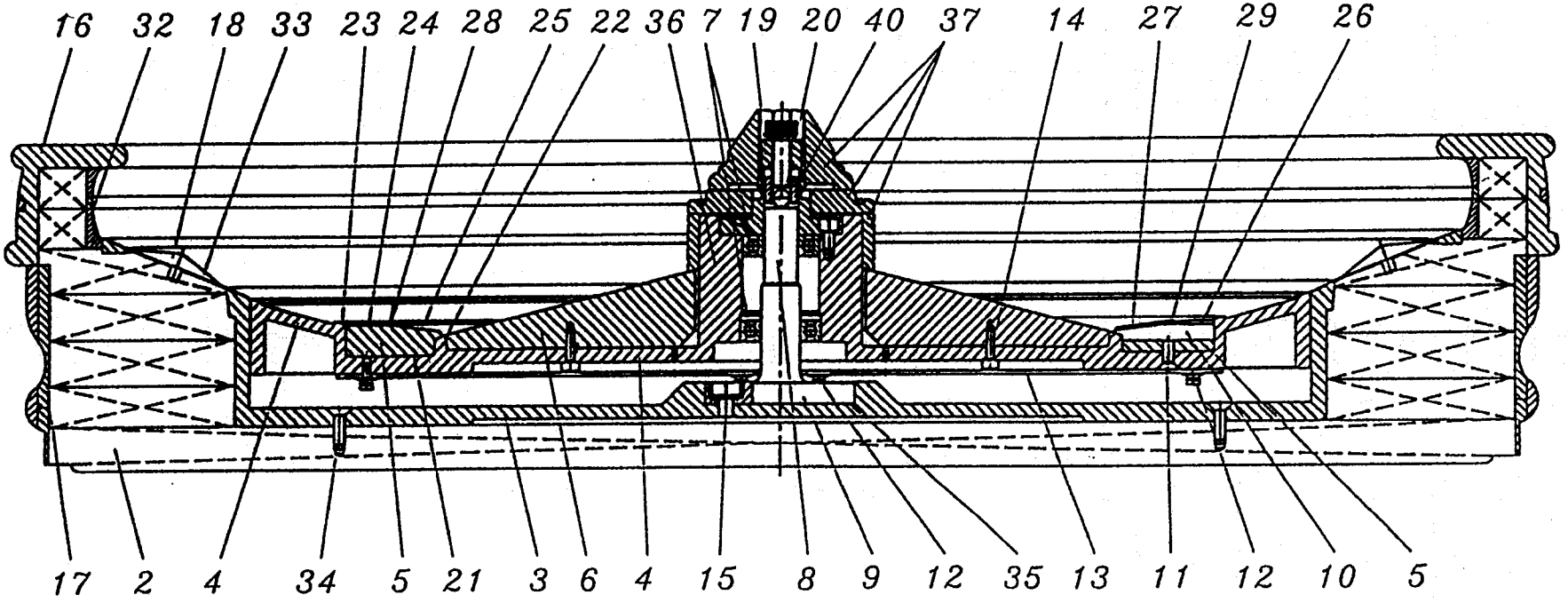

In FIG. 1 a schematical section through a roulette bowl 1 is shown. The roulette bowl 1 comprises a basis plate 2 consisting substantially of wood and having an annular edge portion 17 consisting substantially of wood, that carries in the upper end section a cover surface 18 that confines the running surface 32 of the thrown-in ball to above. A surface 33 follows the running surface 32 which is provided with deflection bodies or baffles 18, the purpose of which is to make the run of the ball uncalculable. A metallic roulette trough 3, preferably consisting of brass, is inserted into this outer casing or, respectively, the base plate 2 and is screwed to the base plate 2 by means of screws 34. It is ensured that the base plate 2 or, respectively, the roulette trough 3 are positioned horizontally in order to ensure an accurate run of the roulette wheel 4.

Figure 2:
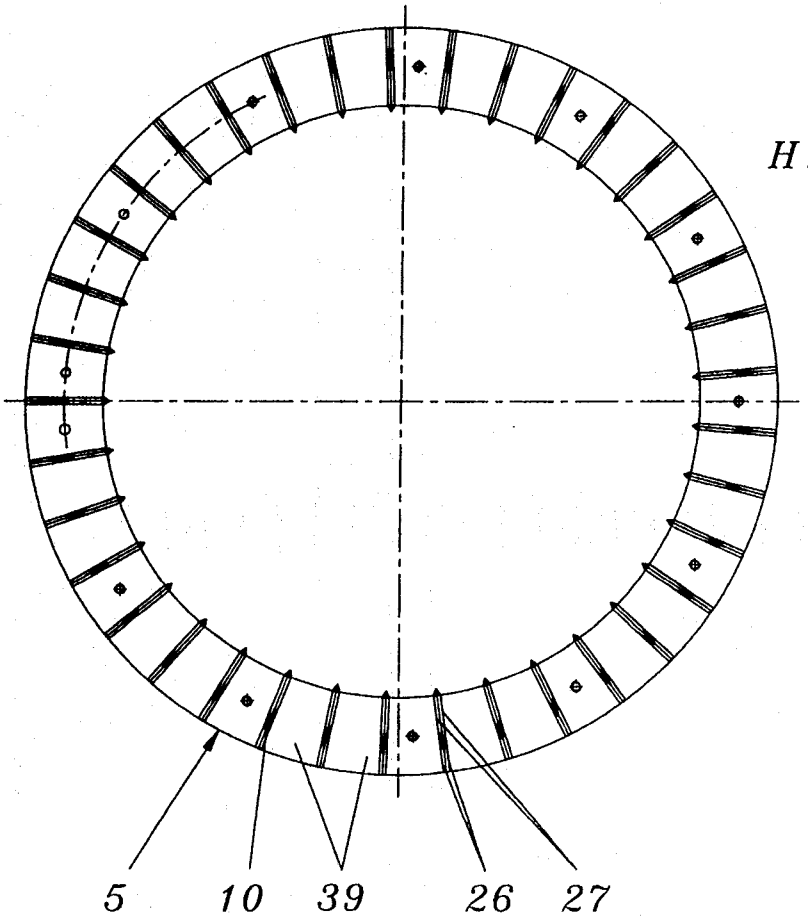

The roulette wheel 4 is bearingly supported with a bearing unit 19 and a bearing ball 20 on the surface 40 of a bearing trunnion 8 and by means of bearings 7 on its periphery. The trunnion 8 is integral with a flange portion 9 that has a circular periphery and is inserted into a recess 35 in the roulette trough 3 and is fixed by means of screws 15. Between the inner portion 36 of the roulette disc 4 surrounding the trunnion 8, and a circular, annular-shaped protrusion 22 on the roulette wheel 4, a truncated cone 6, preferably of wood, is disposed. The roulette wheel 4 may be closed to above and beautified by means of ornamental elements 37. The cone 6 is fixed to the roulette disc 4 by means of screws 14. The roulette wheel 4 is closed to below by a cover plate 13 that is fixed to the roulette disc 4 by means of sealable screws 12, in particular in order to protect screws 11 against manipulations by which screws an insert ring 15 that is disposed in a recess 21 in the roulette wheel 4 is screwed to the roulette wheel 4. This insert ring is integrally provided with fins 10 that laterally confine the fields or pockets 39 of the roulette disc 4. The fins 10 have parallel wall surfaces. FIG. 2 shows a top view on the insert ring 5 that is embedded into the recess 21 of the roulette wheel 4 and is fixed by means of the screws 11. The radially extending fins 10 are shown in detail in the FIGS. 3 to 5.

Figure 3:
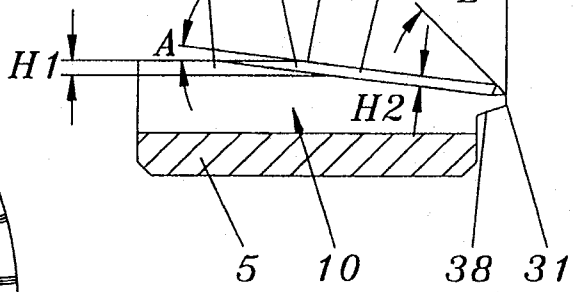

It can be seen from FIG. 3 that the back edge of the fin 10 has a kink 28 so that the fin 10 is divided into an outer, elevated section and into an inner section having a sloping back edge 30. The angle A between the back edge 24 in the outer region and the back edge 25 in the inner region amounts to 2° to 12°.

In connection with FIG. 1 it can further be seen that the outer end of the back edge 24 is disposed at the same level as the inner edge of a circular ring surface 23 of the roulette wheel 4. The inner back edge ends in a nose 31 and merges into an outwardly sloping annular surface of a circular protrusion 22 with an angle E that amounts to about 40° to 50°.

Figure 5:
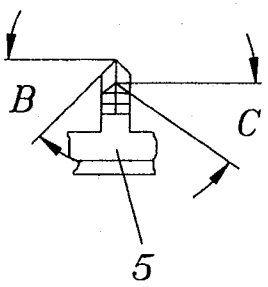
Figure 4:
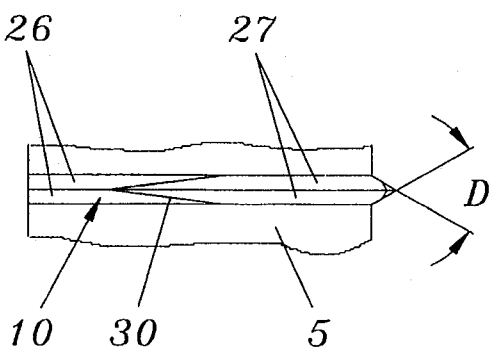

In particular from FIGS. 4 and 5 it can be seen that the back section of the fins 10 is tapered on both sides by oblique surfaces 26 and 27, the angle B between the inclined surfaces 26 and the horizontal direction amounts between 40° to 50° and the angle C between the inclined surfaces 27 and the horizontal direction amounts between 30° and 40°. From the top view according to FIG. 4 it can be seen that the nose 31 ends with an angle D of about 50° to 70°, preferably about 60°.

The bottom edge of the nose 31 is provided with a rising inclined surface 38, the inclination of this inclined surface corresponding to the inclination of the surface of the circular protrusion 22 so that a faying engagement is ensured.

The inclined surfaces 26 and 27 merge into each other by a surface intersection 28 and correspondingly extending edges 30, so that also an optic imposing embodiment of the inclinations is ensured.

We claim:

1. A roulette bowl for gambling casinos, comprising a roulette wheel having a recess, a metal ring with integrally formed radially extending fins confining pockets, the metal ring being fixedly mounted in the recess of the roulette wheel.

2. The roulette bowl of claim 1, wherein the metal is brass.

3. The roulette bowl of claim 1, wherein the metal is coated with nickel.

4. The roulette bowl of claim 1, wherein the metal is coated with chromium.

5. The roulette bowl of claim 1, wherein the ring is fixedly mounted to the recess by screws.

6. The roulette bowl of claim 1, wherein the ring has a width of 19 to 27% of the radius of the ring center line.

7. The roulette bowl of claim 1, wherein the ring has a width of 21 to 25% of the radius of the ring center line.

8. The roulette bowl of claim 1, wherein the fins confining the pockets have back portions with outer back regions and inner back regions.

9. The roulette bowl of claim 8, wherein the back portions form a kink at a kink point, resulting in radially sloping inner back regions with a kink angle (A) being between 2° and 12°.

10. The roulette bowl of claim 9, wherein the kink point is positioned spaced apart from the outer back region 40 to 60% of the ring width.

11. The roulette bowl of claim 8, wherein the back regions have a height of 15 to 27% of the width of the ring.

12. The roulette bowl of claim 8, wherein the surface of the outer back region and the surface of the inner back region are each inclined, the course of the height (Hi) of the outer back region is between 1 to 3 mm and the course of the height (H2) of the inner back region is between 0.5 to 2.5 min.

13. The roulette bowl of claim 1, the roulette wheel being bearingly supported on a trunnion and a flange portion in a roulette trough, wherein the trunnion and the recessed ring are machined out of a single piece of metal.

14. The roulette bowl of claim 12 wherein the inclined surfaces include with the horizontal direction in the outer fin region an angle (B) between 40° to 50°, preferably of about 45°, and in the inner fin region an angle (C) between 30° to 40°, preferably about 35°.

15. The roulette bowl of claim 14 wherein the fins being integral with the ring are provided in their inner end section with a nose directed inwardly and having a bottom edge that rises upwardly, which nose rests on a rising ring surface of an annular shaped protrusion of the roulette wheel.

16. The roulette bowl of claim 15, wherein the outer end of the back edge of the fins is positioned at the same level as an inner edge of an inwardly sloping annular surface of the roulette wheel.

* * * * *